US008118396B2

(12) United States Patent
Umeda

(10) Patent No.: US 8,118,396 B2
(45) Date of Patent: Feb. 21, 2012

(54) INK-JET PRINTER

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 890 days.

(21) Appl. No.: 11/769,004

(22) Filed: Jun. 27, 2007

(65) Prior Publication Data

US 2008/0001987 A1 Jan. 3, 2008

(30) Foreign Application Priority Data

Jun. 30, 2006 (JP) ..... 2006-181774

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 4,819,012 | A | 4/1989 | Kiyohara et al. | |
| 5,081,472 | A * | 1/1992 | Fisher | 347/33 |
| 5,117,244 | A * | 5/1992 | Yu | 347/29 |
| 6,172,691 | B1 * | 1/2001 | Belon et al. | 347/32 |
| 6,352,333 | B1 | 3/2002 | Matsumoto et al. | |
| 6,460,967 | B1 * | 10/2002 | Makita et al. | 347/33 |
| 7,011,388 | B2 * | 3/2006 | Lodal et al. | 347/33 |

FOREIGN PATENT DOCUMENTS

| | | | |
|---|---|---|---|
| JP | 59227459 | A | 12/1984 |
| JP | 10157086 | A | 6/1998 |
| JP | 11198405 | A | 7/1999 |
| JP | 2003011377 | A | 1/2003 |
| JP | 2005007899 | A | 1/2005 |

* cited by examiner

*Primary Examiner* — Matthew Luu
*Assistant Examiner* — Alejandro Valencia
(74) *Attorney, Agent, or Firm* — Baker Botts L.L.P.

(57) ABSTRACT

An ink-jet printer including: (a) a medium feeder operable to feed a recording medium in a medium-feed direction along a medium-feed path; (b) a recording head having (b-1) a nozzle opening surface which extends in a widthwise direction perpendicular to the medium-feed direction and (b-2) a plurality of nozzles which open in the nozzle opening surface and which are arranged in the widthwise direction, the recording head being operable to eject ink toward the recording medium through the nozzles and being pivotable about a pivot axis parallel to the widthwise direction; and (c) at least one waste ink receiver configured to receive the ink ejected through the nozzles, the waste ink receiver being positioned relative to the recording head and the medium-feed path such that the at least one waste ink receiver and the recording head are both located on one of opposite sides of the medium-feed path and such that the waste ink receiver is positioned outside a locus that is described by the nozzle opening surface during pivot movement of the recording head.

13 Claims, 8 Drawing Sheets

INK-JET PRINTER

The present application is based on Japanese Patent Application No. 2006-181774 filed on Jun. 30, 2006, the contents of which are incorporated herein by reference.

BACKGROUND OF THE INVENTION

1. Field of the Invention

The present invention relates to an ink-jet printer of line printer type including a medium feeder operable to feed a recording medium in a medium-feed direction and a recording head operable to eject ink toward the recording medium. In particular, the present invention relates to an ink-jet printer including a waste ink receiver configured to receive the ink ejected through nozzles of the recording head.

2. Discussion of Related Art

There is known an ink-jet printer of line printer type including (a) a medium feeder operable to feed a recording medium in a medium-feed direction and (b) a recording head having (b-1) a nozzle opening surface which extends in a widthwise direction perpendicular to the medium-feed direction and (b-2) a plurality of nozzles which open in the nozzle opening surface and which are arranged in the widthwise direction, the recording head being operable to eject ink toward the recording medium. The ink-jet printer records an image on a recording medium such as a recording sheet by ejecting ink to the recording medium from desired ones of the plurality of nozzles of the recording head while the recording medium is fed in the medium-feed direction by the medium feeder such as a convey roller or a convey belt.

Some nozzles of the recording head, which have not been used for a long time, tend to be clogged by ink. Therefore, for example, as disclosed in Patent Document 1 (JP-A-11-198405), there is provided a recovery area outside a medium-feed area through which the recording medium is fed. At a predetermined timing, the recording head is moved to the recovery area and forcedly ejects ink from the nozzles of the recording head, that is, performs a recovery operation such as a flushing operation, so that the nozzles of the recording head are prevented from being clogged by ink.

However, in a case in which the recovery area is provided outside the medium-feed area, in the ink-jet printer of line printer type, the ink-jet printer is inevitably oversized. In other words, when the recovery operation is to be performed in the line-printer-type ink-jet printer, the recording head is needed to move to the recovery area from the medium-feed area, so that the ink-jet printer needs a wide space including the medium-feed area and the recovery area. In view of this, the Patent Document 1 suggests that a waste ink receiver configured to receive ink ejected through the nozzles of the recording head is provided at a position which is opposed to the recording head and which is located on one of opposite sides of a medium-feed path that is remote from the recording head.

Furthermore, a provision (an arrangement) of a waste ink receiver is suggested in various manners. For example, as disclosed in Patent Document 2 (JP-A-2003-11377), there is provided a waste ink receiver on a back surface of a platen opposite to a front surface of the platen which is opposed to the recording head and which constitutes a medium-feed path. When the recovery operation is performed, the platen is rotated by an angle of 180 degrees so that the waste ink receiver is opposed to the recording head.

SUMMARY OF THE INVENTION

According to the ink-jet printers disclosed in Patent Document 1 and 2, when the recording medium is fed above the waste ink receiver which is opposed to the recording head, the recovery operation cannot be performed. Thus, in a case in which an image is recorded on a long recording medium in the medium-feed direction such as a roll sheet, the recovery operation cannot be performed when the recording head is clogged by ink during an image recording operation, leading to a lower quality of image recorded on a recording medium.

In the above-described technical background, the present invention has been developed. It is therefore an object of the present invention to solve the above-indicated problem and to be able to perform the recovery operation so as to receive ink ejected from the nozzles of the recording head even when the recording medium is fed over the position opposed to the recording head, and to easily reduce a size of the ink-jet printer.

According to the present invention, there is provided an ink-jet printer, comprising: (a) a medium feeder operable to feed a recording medium in a medium-feed direction along a medium-feed path; (b) a recording head having (b-1) a nozzle opening surface which extends in a widthwise direction perpendicular to the medium-feed direction and (b-2) a plurality of nozzles which open in the nozzle opening surface and which are arranged in the widthwise direction, the recording head being operable to eject ink toward the recording medium through the nozzles and being pivotable about a pivot axis parallel to the widthwise direction; and (c) at least one waste ink receiver configured to receive the ink ejected through the nozzles, the waste ink receiver being positioned relative to the recording head and the medium-feed path such that the at least one waste ink receiver and the recording head are both located on one of opposite sides of the medium-feed path and such that the waste ink receiver is positioned outside a locus that is described by the nozzle opening surface during pivot movement of the recording head.

In the present ink-jet printer, the recording head is pivotable about a pivot axis parallel to the widthwise direction and the waste ink receiver is positioned relative to the recording head and the medium-feed path such that the at least one waste ink receiver is positioned outside a locus that is described by the nozzle opening surface during pivot movement of the recording head. Therefore, in the present ink-jet printer, there is no need to provide an area for exclusively receiving the ink ejected through the nozzles of the recording head when the recovery operation is performed and to move the recording head to an area, such as the recovery area, outside the medium-feed area in order to perform the recovery operation.

Therefore, the present ink-jet printer can be easily downsized. Also, the waste ink receiver is positioned relative to the recording head and the medium-feed path such that the at least one waste ink receiver and the recording head are both located on one of opposite sides of the medium-feed path. Therefore, even when the recording medium is fed over a position opposed to the recording head, the recovery operation can be performed so that the waste ink receiver receives ink ejected through the nozzles of the recording head. Thus, in a case in which an image is recorded on a long recording medium in the medium-feed direction such as a roll sheet, the recovery operation can be performed when the recording head is clogged by ink during the image recording, leading to improving the quality of images recorded on each recording medium.

In the present ink-jet printer, the waste ink receiver may be arranged to receive ink from the recording head while the waste ink receiver is in close contact with the nozzle opening surface. The recovery operation, in which the nozzles of the recording head eject ink, includes (1) a flushing operation in which an actuator of the recording head is driven to eject ink through the nozzles of the recording head, similarly in a normal image recording operation, and (2) a purging operation in which a pumping device, operable to supply ink to the recording head, is forcedly driven to eject ink through the nozzles. In the purging operation, ink is ejected or overflowed through the nozzles of the recording head. Therefore, in the case in which the waste ink receiver is in close contact with the nozzle opening surface during the purging operation, the waste ink receiver can certainly receive the ink from the recording head.

Further, the waste ink receiver may be arranged to receive ink from the recording head while the waste ink receiver is spaced from the nozzle opening surface. In the flushing operation, the recording head cannot eject ink when the nozzle opening surface is fluid-tightly closed. Therefore, in the case in which the waste ink receiver is spaced from the nozzle opening surface during the flushing operation, the flushing operation is finely performed and the waste ink receiver can certainly receive ink from the recording head. However, the waste ink receiver is not limited to those embodiments mentioned above.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
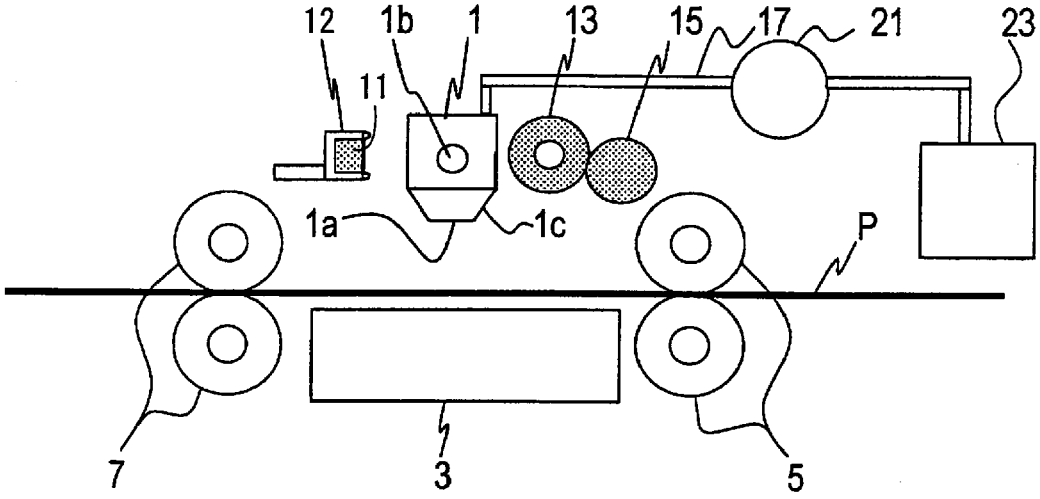
FIG. 1 is a schematic view showing a pertinent structure of an ink-jet printer as a first embodiment of the present invention.

Hereinafter, there will be described preferred embodiments of the present invention by reference to the drawings. As shown in FIG. 1, an ink-jet printer, as a first embodiment of the present invention, includes a recording head 1 having a nozzle opening surface 1*a* and a plurality of nozzles 25*c* (shown in FIG. 3) which open in the nozzle opening surface 1*a*. The recording head 1 extends in a widthwise direction perpendicular to a sheet-feed direction as a medium-feed direction in which a recording sheet P as a recording medium is fed. The recording head 1 is operable to eject ink toward the recording sheet P through the nozzles 25*c*. Below the recording head 1, there is provided a platen 3 which supports the recording sheet P horizontally (flatly). In the present embodiment, the recording sheet P is described as one example of the recording medium, however, any types of recording media on which images and/or characters can be recorded by the recording head may be adopted, such as a plate member, a sheet made of a synthetic resin, and a disc for optical recording.

On an upstream side of the platen 3 in the sheet-feed direction, a pair of convey rollers 5 as a medium feeder are provided, while a pair of sheet-discharging roller 7 as a medium feeder are provided on a downstream side of the platen 3 in the sheet-feed direction. The pair of convey rollers 5 cooperate with each other to nip the recording sheet P and feed the same P onto the platen 3 in the sheet-feed direction along a sheet-feed path as a medium-feed path. The pair of sheet-discharging rollers 7 cooperate with each other to nip and discharge the recording sheet P in the sheet-feed direction. One of the pair of sheet-discharging rollers 7 which is operable to press an upper surface (a surface on which an image is recorded, as mentioned later) of the recording sheet P is a spur roller having a plurality of sharp projections on its outer circumferential surface, that is, having a smaller contact area at which the roller is brought into contact with the recording sheet P.

The plurality of nozzles 25*c* of the recording head 1 are arranged in the widthwise direction and over an area having a larger width than a maximum width of the recording sheet P which can be fed. The recording head 1 is pivotable about a pivot axis 1*b* parallel to the widthwise direction. A flushing receiving portion 11 as a second waste-ink receiver and an absorbing roller 13 as a first waste-ink receiver are positioned outside a locus that is described by the nozzle opening surface 1*a* during pivot movement of the recording head 1. The flushing receiving portion 11 and the absorbing roller 13 are configured to receive a waste ink ejected through the nozzles 25*c* of the recording head 1. The recording head 1 has chamfered or inclined surfaces 1*c* on respective side edges of the nozzle opening surface 1*a* that are opposite to each other in a direction of the pivot movement of the recording head 1, so that the recording head 1 is prevented from contacting the flushing receiving portion 11 during the pivot movement of the recording head 1.

The flushing receiving portion 11 is provided by a non-contact absorbing member placeable in a non-contact receiving state that enables the flushing receiving portion 11 to receive and absorb the waste ink from the nozzles 25*c* of the recording head 1 while the non-contact absorbing member is spaced from the nozzle opening surface 1*a*. The non-contact absorbing member (the flushing receiving portion) 11 is located on a downstream side of the recording head 1 in the sheet-feed direction and located at substantially the same height position as that of the pivot axis 1*b* of the recording head 1. The non-contact absorbing member 11 is stored in a generally container-like shaped storage device 12. The storage device 12 has an opening which opens toward the pivot axis 1*b* and through which the non-contact absorbing member (the flushing receiving portion 11) is exposed. The absorbing roller 13 constitutes a contact absorbing member placeable in a contact receiving state that enables the absorbing roller 13 to receive the waste ink from the recording head 1 and to absorb the waste ink stuck in the nozzles 25*c* while the absorbing roller 13 is in close contact with the nozzle opening surface 1*a* of the recording head 1. The absorbing roller 13 has an outer circumferential surface contactable with the nozzle opening surface 1*a* of the recording head 1. The absorbing roller 13 is rotatable about a rotation axis extending in parallel with the pivot axis 1*b* of the recording head 1, that is, in the widthwise direction and which is located on an upstream side of the recording head 1 in the sheet-feed direction and located at substantially the same height position as that of the pivot axis 1*b*.

There is provided a cleaning roller 15 which constitutes an ink-absorbing member and which is rotatable about a rotation axis extending in parallel with the rotation axis of the absorbing roller 13, that is, in the widthwise direction and has an outer circumferential surface which is in contact with the outer circumferential surface of the absorbing roller 13. When the absorbing roller 13 is rotated by the pivot movement of the recording head 1 in the contact receiving state in which the outer circumferential surface of the absorbing roller 13 is in contact with the nozzle opening surface 1*a*, the cleaning roller 15 is rotated by the rotation of the absorbing roller 13 so as to absorb the absorbed waste ink from the absorbing roller 13. It is noted that the ink-absorbing member constituted by the cleaning roller 15 is made of a material capable of effectively absorbing the waste ink.

Figure 2:
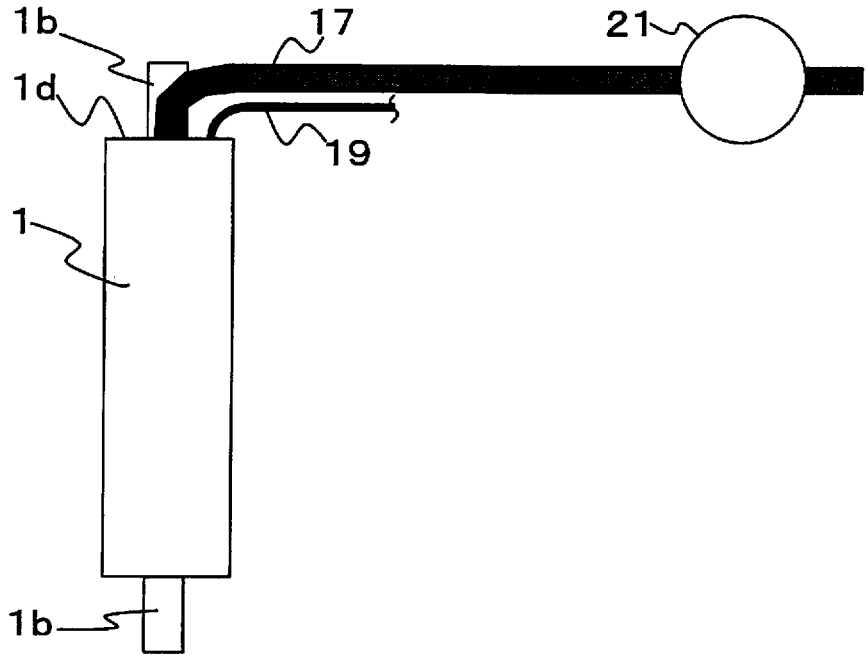
FIG. 2 is a plan view of a recording head of the ink-jet printer.

Further, in the ink-jet printer, there is provided a tube 17 for supplying ink to the recording head 1 and a cable 19 for transmitting an electric signal (described later) to the recording head 1. A pumping device 21 is driven to supply ink to the recording head 1 from an ink cartridge 23 via the tube 17. As shown in FIG. 2, the tube 17 and the cable 19 are both connected to a side surface 1*d* of the recording head 1, which is provided by one of surfaces of the recording head 1 that are opposite to each other as viewed in the widthwise direction. Therefore, the tube 17 and the cable 19 are prevented from contacting the nozzle opening surface 1*a* of the recording head 1 and offer (make) substantially little resistance to the pivot movement of the recording head 1 about the pivot axis 1*b*, leading to smooth pivot movement of the recording head 1.

Figure 3:
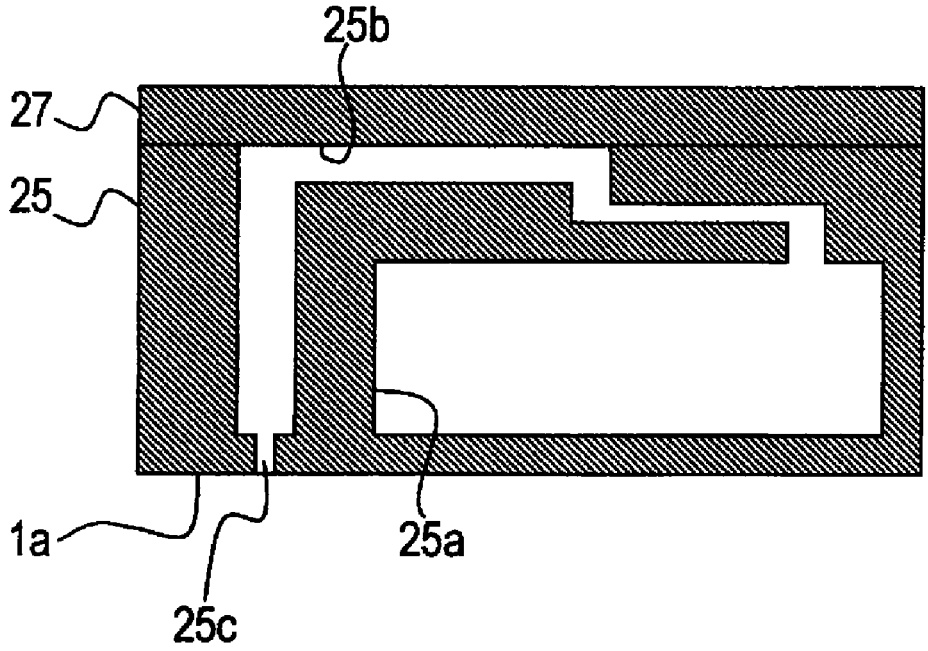
FIG. 3 is a cross-sectional view schematically showing an internal structure of the recording head of the ink-jet printer.

As shown in FIG. 3, the ink-jet printer further includes a passage unit 25 and an actuator unit 27. The passage unit 25 has a stacked structure including a multiplicity of metal plate members which are stacked on each other and which have cavities. The passage unit 25 has a manifold 25*a* which communicates with the tube 17, a plurality of pressure chambers 25*b* each of which opens widely to the actuator unit 27, and the plurality of nozzles 25*c* each of which has a small-diameter opening on the nozzle opening surface 1*a*. An outlet of the manifold 25*a* is connected to each of the nozzles 25*c* via respective ink passages. The manifold 25*a* is common to the nozzles 25*c* while the plurality of ink passages are provided individually for the respective nozzles 25*c*. The actuator unit 27 includes a plurality of piezoelectric sheets that are stacked on each other, and has individual electrodes for the respective pressure chambers 25*b*. Therefore, when an electric signal is transmitted through the cable 19 to the electrode opposed to the pressure chamber 25*b* communicating with the desired nozzles 25*c*, ink stored in the above-mentioned pressure chamber 25*b* is pressurized to oscillate so that the ink is ejected through the desired nozzles 25*c*.

Figure 4:
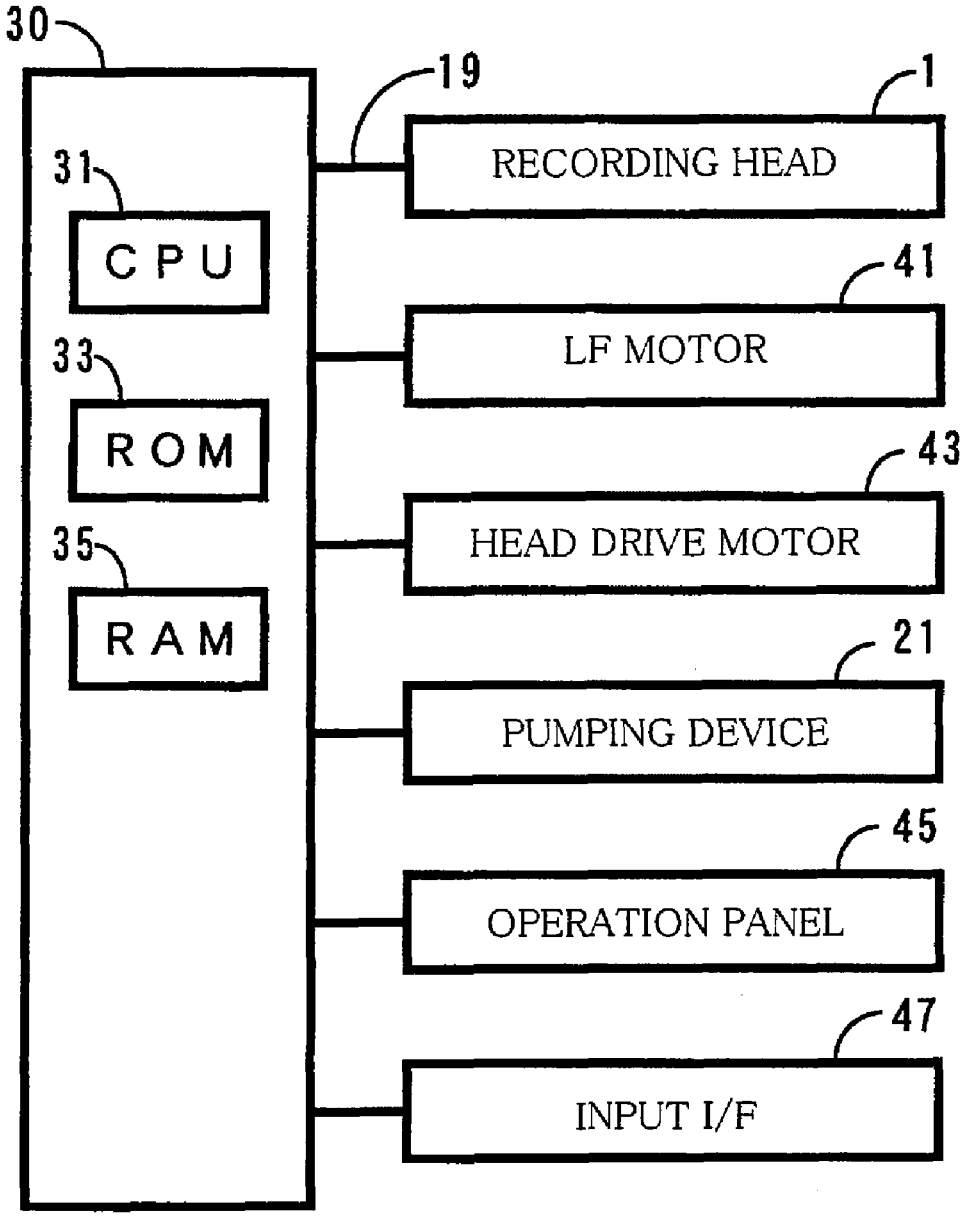
FIG. 4 is a block diagram illustrating an arrangement of a control portion of the ink-jet printer.

Referring next to the block diagram of FIG. 4, the ink-jet printer further includes a control portion 30 for controlling various operations of the ink-jet printer. The control portion 30 is constituted by a microcomputer mainly including a CPU (Central Processing Unit) 31, a ROM (Read Only Memory) 33, and a RAM (Random Access Memory) 35. The control portion 30 is connected via driver circuits (not shown) to the recording head 1, the pumping device 21, a LF (line feed) motor 41 for driving the convey roller 5 and the sheet-discharging roller 7, and a head drive motor 43 for driving the recording head 1 to pivot about the pivot axis 1*b*. The control portion 30 is also connected to an operation panel 45 that is used by a user to input various commands to operate the ink-jet printer and an input interface (input I/F) 47 to which various data are inputted from a personal computer (not shown).

Figure 5A:
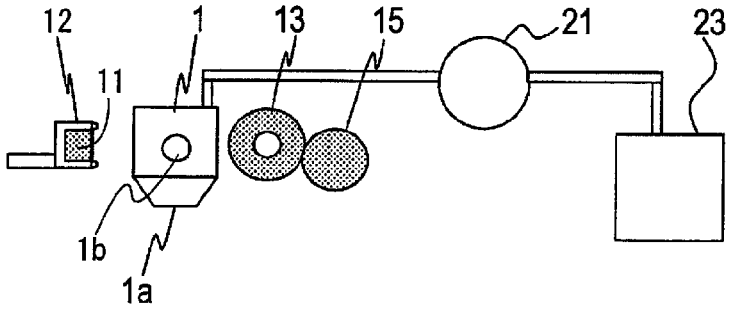
FIGS. 5A through 5C are views indicating changes in the state of the ink-jet printer during a recovery operation.

In the control portion 30, when image data are inputted to the input I/F 47, the pumping device 21 and the recording head 1 are driven to eject ink toward the recording sheet P through the nozzles 25*c* of the recording head 1 while the LF motor 41 is driven to feed the recording sheet P, so that images are recorded on each of the recording sheet P based on the image data. As shown in FIGS. 1 and 5A, during the image recording operation mentioned above or a waiting state, the nozzle opening surface 1*a* is positioned in an angular position of 0 degrees or in an image recording angular position so as to be directed precisely downwardly toward the platen 3.

In a case in which the ink-jet printer is in initial stage of use, the ink-jet printer has been left unused for a long time, or a user inputs by the operation panel 45 to the control portion 30 to perform the recovery operation of the recording head 1, the recovery operation is performed by the control portion 30, as described below.

Figure 5B:
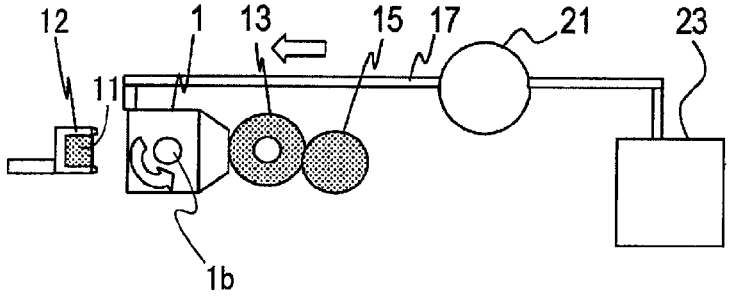
Figure 6:
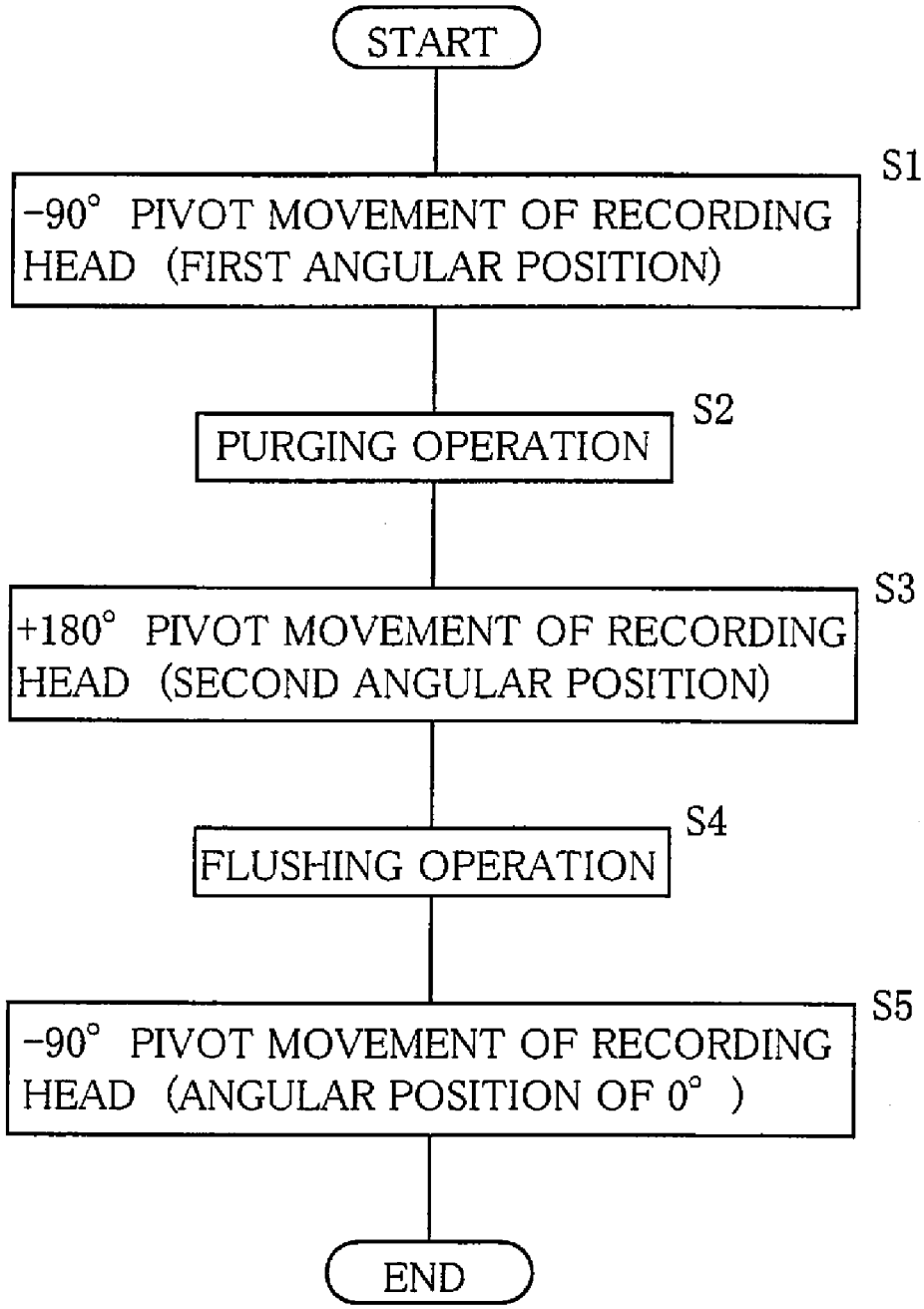
FIG. 6 is a flow chart illustrating a recovery operation routine executed by the control portion of the ink-jet printer.

Reference is now made to the flow chart in FIG. 6 illustrating the recovery operation routine. As shown in FIG. 6, when the recovery operation routine starts, in step S1, the control portion 30 drives the head drive motor 43 to pivot the recording head 1 by an angle of 90 degrees toward an upstream side in the sheet-feed direction (hereinafter, an angle of −90 degrees). As shown in FIG. 5B, when the nozzle opening surface 1*a* of the recording head 1 is thus positioned in a first angular position by the pivot movement of the recording head 1, the absorbing roller 13 is placed in the contact receiving state in which the absorbing roller 13 is in close contact with the nozzle opening surface 1*a*. Then, in step S2, the control portion 30 performs the purging operation in which the control portion 30 forcedly drives the pumping device 21 to supply ink to the manifolds 25*a*. When the purging operation is performed, the ink is ejected or overflowed through the nozzles 25*c* of the recording head 1. Since the absorbing roller 13 is in the contact receiving state, the absorbing roller 13 can satisfactorily absorb the ink from the recording head 1. In the case in which ink is firmly stuck in the nozzles 25*c*, when the purging operation is performed, the ink is removed as the waste ink from the nozzles 25*c* and then absorbed by the absorbing roller 13.

Figure 5C:
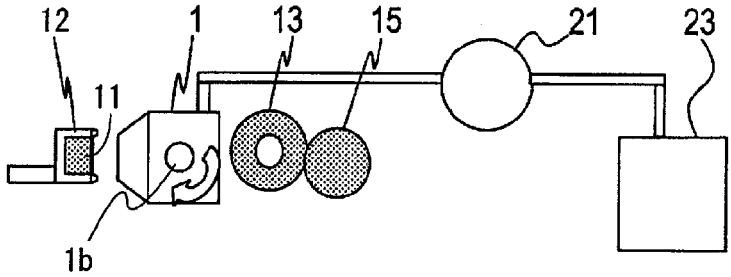

Next, in step S3, the control portion 30 drives the head drive motor 43 to pivot the recording head 1 by an angle of +180 degrees. That is, the nozzle opening surface 1*a* of the recording head is pivoted by an angle of 90 degrees toward a downstream side in the sheet-feed direction from a state of the recording head 1 in the image recording operation shown in FIG. 5A. As shown in FIG. 5C, when the nozzle opening surface 1*a* of the recording head 1 is thus positioned in a second angular position by the above-mentioned pivot movement of the recording head 1, the flushing receiving portion 11 is placed in the non-contact receiving state in which the flushing receiving portion 11 is spaced from the nozzle opening surface 1*a*. Then, in step S4, the flushing operation is performed, that is, the control portion 30 transmits (inputs) the electric signal to the recording head 1 to oscillate the actuator unit 27 so that ink is ejected through the nozzles 25*c*. The ink ejected from the nozzles 25*c* is received by the flushing receiving portion 11. Thus, when the flushing operation is performed, the ink lightly stuck in the nozzles 25*c* can be removed as the waste ink from the nozzles 25*c* and then received by the flushing receiving portion 11. Finally, in step S5, the control portion 30 drives the recording head 1 to pivot by an angle of −90 degrees so as to be back in the image recording angular position of the recording head 1, that is, the nozzle opening surface 1*a* is directed downwardly, as shown in FIG. 5A.

Since the recovery operation is performed as described above, when image data are next inputted to the input I/F 47, the recording head 1 can appropriately eject ink through the nozzles 25*c* so that high-quality images can be recorded on each recording sheet P with high stability.

Also, right before the image recording starts, every predetermined seconds during the image recording, or when a predetermined time has passed since the image recording is last performed, the control portion 30 drives the recording head 1 to pivot by an angle of +90 degrees so as to perform only the flushing operation. Thus, ink lightly stuck in the nozzles 25*c* can be removed as waste ink from the nozzles 25*c*. In the present embodiment, the recording head 1 is pivotable in opposite directions only within an angular range of 180 degrees (±90 degrees), so that the tube 17 and the cable 19 connected to side surface 1*d* of the recording head 1 in the widthwise direction are preferably prevented from contacting the nozzle opening surface 1*a* and being twisted.

In the present ink-jet printer, the flushing receiving portion 11 and the absorbing roller 13 are positioned along the locus that is described by the nozzle opening surface 1*a* during the pivot movement of the recording head 1, so that the ink-jet printer can be easily downsized. Also, since the flushing receiving portion 11, the absorbing roller 13 and the recording head 1 are all located on one of opposite sides of the sheet-feed path, the recovery operation such as the purging operation and the flushing operation can be performed even when the recording sheet P is fed onto the platen 3. Therefore, when an image is recorded on a long recording sheet in the sheet-feed direction such as a roll sheet, the recovery operation can be performed during the image recording, leading to further improvement in a quality of image on the recording sheet P. Furthermore, in the present embodiment, relative to the image recording angular position of the nozzle opening surface 1*a*, the flushing receiving portion 11 is located on an angular position of +90 degrees and the absorbing roller 13 is located on an angular position of −90 degrees, that is, the recording head 1, the flushing receiving portion 11 and the absorbing roller 13 are all positioned at substantially the same height position in a vertical direction perpendicular to the sheet-feed direction, leading to reduction in the vertical size of the ink-jet printer.

in the present embodiment, the convey rollers 5 and the sheet-discharging rollers 7 correspond to a sheet feeder as a medium feeder operable to feed the recording sheet P in the sheet-feed direction along the sheet-feed path. It is to be understood that the present invention may be embodied with various changes, modifications, and improvements that may occur to a person skilled in the art without departing from the spirit and scope of the invention defined in the appended claims. For example, one of the flushing receiving portion 11 and the absorbing roller 13 may be omitted. One of the flushing receiving portion 11 and the absorbing roller 13, and the recording head 1 may be located on one of opposite sides of the sheet-feed path while the other of the flushing receiving portion 11 and the absorbing roller 13 may be located on the other of opposite sides of the sheet-feed path. In this modified embodiment, the other of the flushing receiving portion 11 and the absorbing roller 13 can be used when the recording sheet P is not fed on the platen 3.

Figure 7A:
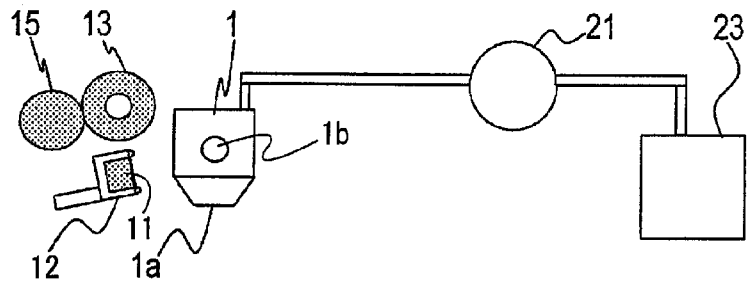
FIGS. 7A through 7C are views indicating changes in the state of an ink-jet printer as a second embodiment of the present invention during a recovery operation.
Figure 7B:
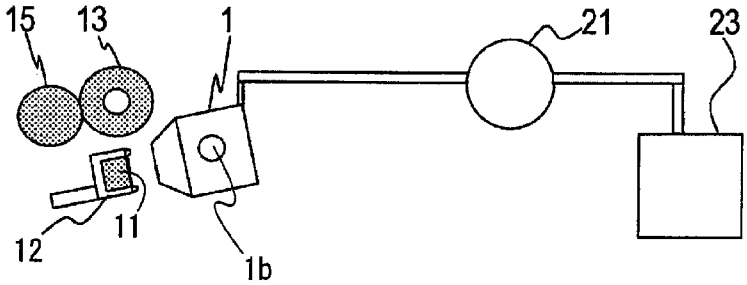
Figure 7C:
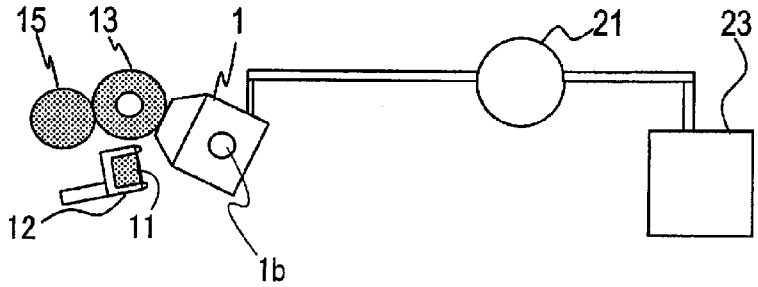

The flushing receiving portion 11 and the absorbing roller 13 may have different shapes and/or different arrangements (provision). For example, FIGS. 7A through 7C show an embodiment in which the flushing receiving portion 11 and the absorbing roller 13 are both located on a downstream side of the recording head 1 in the sheet-feed direction. In the present embodiment, when the recording head is pivoted by an angle of approximately +60 degrees from the image recording angular position shown in FIG. 7A, the nozzle opening surface 1*a* of the recording head 1 is positioned in a second angular position and is opposed to the flushing receiving portion 11 so that the flushing operation is performed as described in the above-mentioned embodiment. As shown in FIG. 7C, when the recording head 1 is pivoted further by an angle of approximately +60 degrees, the nozzle opening surface 1*a* is positioned in a first angular position and is in close contact with the absorbing roller 13 so that the purging operation is performed. In the present embodiment, the flushing receiving portion 11 and the absorbing roller 13 are both located on the downstream side of the recording head 1 in the sheet-feed direction, so that a pick-up roller (not shown) for feeding the recording sheet P and so on can be provided close (in the vicinity to) to the platen 3, leading to reduction in a size of the ink-jet printer in the sheet-feed direction.

Also, in a case in which the flushing receiving portion 11 and the absorbing roller 13 are both located on an upstream side of the recording head 1 in the sheet-feed direction, the ink-jet printer can be downsized in the sheet-feed direction.

Figure 8A:
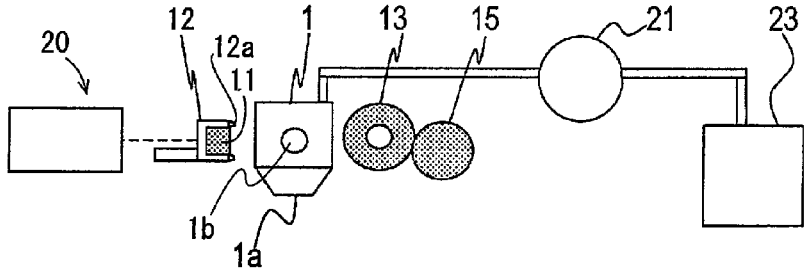
FIGS. 8A and 8B are views indicating changes in the state of an ink-jet printer as a third embodiment of the present invention during a recovery operation.
Figure 8B:
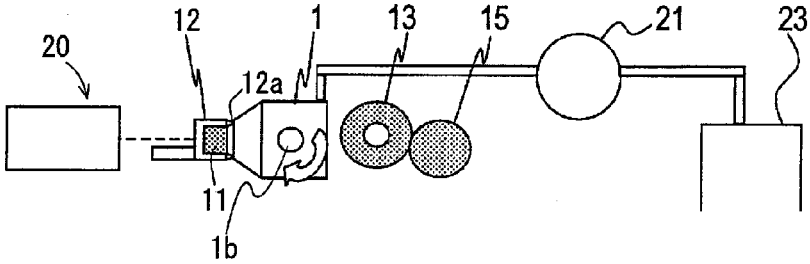

As shown in FIGS. 8A and 8B, the flushing receiving portion 11 may further include a moving device 20 which is operable to move the storage device 12 (storing therein the flushing receiving portion 11) relative to the recording head 1. In this case, it is preferable that the generally container-like shaped storage device 12 has an opening through which the flushing receiving portion 11 is exposed and a contactable surface 12*a* which surrounds the opening. The moving device 20 is operable to move the flushing receiving portion 11 between a contact position in which the contactable surface 12*a* of the storage device 12 is in close contact with the nozzle opening surface 1*a* of the recording head 1 and a spaced position in which the contactable surface 12*a* is spaced apart from the nozzle opening surface 1*a*. It is more preferable that the contactable surface 12*a* of the storage device 12 is made of a rubber or a similar material. In this case, the storage device 12 may be made of a rubber or a similar material as a whole, or a main body of the storage device 12 may be made of a hard material such as a hard synthetic resin while a periphery of the opening of the storage device 12 may be made of a rubber or a similar material. As shown in FIG. 8B, when the flushing receiving portion 11 is moved to the contact position, the contactable surface 12*a* of the storage device 12 is in close contact with the nozzle opening surface 1*a* so as to function as a nozzle cap. A nozzle cap is commonly used when the recording sheet P is not fed onto the platen 3, so that the nozzle cap may be located on a side of the platen 3 with respect to the sheet-feed path and be moved upward to the nozzle opening surface 1*a*.

Furthermore, at least one of the flushing receiving portion 11 and the absorbing roller 13 may be arranged to retract away from the locus that is described by the nozzle opening surface 1*a* during the pivot movement of the recording head 1, so that the at least one of the flushing receiving portion 11 and the absorbing roller 13 is prevented from interfering in the recording head 1. This embodiment can improve a degree of freedom of design of the recording head 1.

In the above-mentioned embodiments, the flushing receiving portion 11 and the absorbing roller 13 are located on different angular positions of the recording head 1 corresponding to the first angular position and the second angular position of the nozzle opening surface 1*a* of the recording head 1. However, the flushing receiving portion 11 and the absorbing roller 13 may be located on a same angular position and one of the flushing receiving portion 11 and the absorbing roller 13 may be switched to the other, depending on situations. In the above-mentioned embodiments, the desired one of the flushing receiving portion 11 and the absorbing roller 13 can be both used by the pivot movement of the recording head 1 without a device that is provided exclusively for switching one of the flushing receiving portion 11 and the absorbing roller 13 to the other, leading to a simplified structure of the ink-jet printer.

What is claimed is:

1. An ink-jet printer, comprising:

(a) a medium feeder operable to feed a recording medium in a medium-feed direction along a medium-feed path;

(b) a platen configured to support the recording medium fed by the medium feeder;

(c) a recording head having (c-1) a nozzle opening surface which extends in a widthwise direction perpendicular to the medium-feed direction; and (c-2) a plurality of nozzles which open in the nozzle opening surface and which are arranged in the widthwise direction, the recording head being operable to eject ink toward the recording medium through the nozzles and being pivotable about a pivot axis parallel to the widthwise direction;

(d) a first waste-ink receiver disposed on an upstream side of the recording head in the medium-feed direction and configured to receive the ink ejected through the nozzles during purging operation; and (e) a second waste-ink receiver disposed on a downstream side of the recording head in the medium-feed direction and configured to receive ink ejected through the nozzles during flushing operation, wherein the recording head, the first waste-ink receiver, and the second waste-ink receiver are opposed to the platen across the medium-feed path, wherein the recording head is interposed between the first waste-ink receiver disposed on the upstream side of the recording head in the medium-feed direction and the second waste-ink receiver disposed on the downstream side of the recording head in the medium-feed direction, and wherein the first waste-ink receiver and the second waste-ink receiver are positioned outside a locus that is described by the nozzle opening surface during pivot movement of the recording head.

2. The ink-jet printer according to claim 1, wherein the first waste-ink receiver is closely contactable with the nozzle opening surface of the recording head so as to receive the ink from the recording head.

3. The ink-jet printer according to claim 1, wherein the second waste-ink receiver receives the ink from the recording head in a state in which the second waste-ink receiver is spaced from the nozzle opening surface of the recording head.

4. The ink jet printer according to claim 1, wherein the first waste-ink receiver is placeable in a contact receiving state that enables the first waste-ink receiver to receive the ink from the recording head while the first waste-ink receiver is in close contact with the nozzle opening surface, and the second waste-ink receiver is placeable in a non-contact receiving state that enables the second waste-ink receiver to receive the ink from the recording head while the second waste-ink receiver is spaced from the nozzle opening surface, wherein the first waste-ink receiver is placed in the contact receiving state when the nozzle opening surface is positioned in a first angular position by the pivot movement of the recording head, and wherein the second waste-ink receiver is placed in the non-contact receiving state when the nozzle opening surface is positioned in a second angular position by the pivot movement of the recording head.

5. The ink-jet printer according to claim 4, wherein the first waste-ink receiver includes a contact absorbing member which is contactable with the nozzle opening surface of the recording head so as to absorb the ink from the nozzles of the recording head, and wherein the second waste-ink receiver includes a non-contact absorbing member so as to absorb the ink from the nozzles of the recording head in the non-contact receiving state.

6. The ink-jet printer according to claim 5, wherein the contact absorbing member of the first waste-ink receiver is provided by an absorbing roller which is rotatable about a rotation axis extending in the widthwise direction and which has an outer circumferential surface contactable with the nozzle opening surface of the recording head, and wherein the absorbing roller is rotated by the pivot movement of the recording head in the contact receiving state in which the outer circumferential surface of the absorbing roller is in contact with the nozzle opening surface of the recording head.

7. The ink-jet printer according to claim 6, further comprising (f) a cleaning roller which is rotatable about a rotation axis extending in the widthwise direction and has an outer circumferential surface which is in contact with the outer circumferential surface of the absorbing roller, and which absorbs the absorbed ink from the absorbing roller.

8. The ink-jet printer according to claim 5, further comprising:

(g) a generally container-like shaped storage device storing therein the non-contact absorbing member of the second waste-ink receiver, the storage device having (g-1) an opening through which the non-contact absorbing member is exposed and (g-2) a contactable surface which surrounds the opening; and (h) a moving device operable to move one of the storage device and the recording head, relative to the other of the storage device and the recording head, between a contact position in which the contactable surface of the storage device is in close contact with the nozzle opening surface of the recording head and a spaced position in which the contactable surface is spaced apart from the nozzle opening surface.

9. The ink-jet printer according to claim 1,wherein the recording head is pivotable in opposite directions from a recording position in which the recording head ejects the ink toward the recording medium supported by the platen, and wherein the nozzle opening surface faces one of the first waste-ink receiver and the second waste-ink receiver when the recording head pivots from the recording position in one of the opposite directions, and the nozzle opening surface faces the other of the first waste-ink receiver and the second waste-ink receiver when the recording head pivots from the recording position in the other of the opposite directions.

10. The ink-jet printer according to claim 1, further comprising a tube for supplying ink to the recording head and a cable for transmitting an electric signal to the recording head, and wherein at least one of the tube and the cable is connected to one of opposite side surfaces of the recording head that are opposite to each other in the widthwise direction.

11. The ink jet printer according to claim 1, wherein the platen has a flat face to which the recording head, the first waste-ink receiver, and the second waste-ink receiver are opposed, and wherein the first waste-ink receiver is located upstream of the recording head in the medium-feed direction over the flat face of the platen while the second waste-ink receiver is located downstream of the recording head in the medium-feed direction over the flat face.

12. The ink jet printer according to claim 9, wherein the nozzle opening surface faces the first waste-ink receiver when the recording head pivots in one of the opposite directions from the recording position, and the nozzle opening surface faces the second waste-ink receiver when the recording head pivots in the other of the opposite directions from the recording position.

13. The ink jet printer according to claim 1, wherein each of the first waste-ink receiver and the second waste-ink receiver is located at substantially the same height position as that of a pivot axis of the recording head.

* * * * *